US009074604B2

(12) United States Patent
Konishi et al.

(10) Patent No.: US 9,074,604 B2
(45) Date of Patent: Jul. 7, 2015

(54) CENTRIFUGAL FAN

(75) Inventors: Atsuo Konishi, Kyoto (JP); Hiroyoshi Teshima, Kyoto (JP)

(73) Assignee: Nidec Corporation, Kyoto (JP)

( * ) Notice: Subject to any disclaimer, the term of this patent is extended or adjusted under 35 U.S.C. 154(b) by 713 days.

(21) Appl. No.: 13/432,096

(22) Filed: Mar. 28, 2012

(65) Prior Publication Data

US 2012/0275915 A1 Nov. 1, 2012

(30) Foreign Application Priority Data

Apr. 26, 2011 (JP) ..... 2011-098502

(51) Int. Cl.
*F04D 17/08* (2006.01)
*F04D 17/16* (2006.01)
*F04D 25/06* (2006.01)

(52) U.S. Cl.
CPC ..... *F04D 17/164* (2013.01); *F04D 25/0606* (2013.01)

(58) Field of Classification Search
CPC ..... F04D 17/105; F04D 17/12; F04D 17/122; F04D 17/162; F04D 17/164; F04D 25/606; F04D 29/424; F04D 29/662; F05B 2260/2241
USPC ..... 415/99–102, 119, 144, 171.1, 173.6, 415/174.4, 198.1, 199.1, 204, 206; 416/144, 185, 186 R, 500; 128/204.18
See application file for complete search history.

(56) References Cited

U.S. PATENT DOCUMENTS 5,591,008 A * 1/1997 Wrobel et al. ..... 416/144
5,743,721 A * 4/1998 Graham et al. ..... 415/58.4
5,857,348 A 1/1999 Conry
2006/0051205 A1 3/2006 Platz
2008/0069689 A1 3/2008 Sun et al.
2008/0260515 A1 10/2008 Anami et al.
2009/0087299 A1* 4/2009 Agrawal et al. ..... 415/1
2009/0301485 A1* 12/2009 Kenyon et al. ..... 128/204.18
2011/0073110 A1 3/2011 Kenyon et al.

FOREIGN PATENT DOCUMENTS

CN 101850147 A 10/2010
EP 1 318 307 A1 6/2003
EP 1 643 131 A2 4/2006
EP 1 985 861 A2 10/2008
EP 2 287 471 A1 2/2011
JP 4-330398 A 11/1992
JP 2003-214395 A 7/2003
JP 2009-537735 A 10/2009

* cited by examiner

*Primary Examiner* — Dwayne J White
*Assistant Examiner* — Alexander White
(74) *Attorney, Agent, or Firm* — Keating & Bennett, LLP

(57) ABSTRACT

A centrifugal fan includes an upstream side impeller, a downstream side impeller, a motor, and a housing arranged to accommodate the upstream side impeller, the downstream side impeller, and the motor. The housing includes a first intake port through which a gas is drawn from an outside, an exhaust port through which the gas is discharged to the outside, and a flow path defined within the housing to bring the first intake port and the exhaust port into communication with each other. The flow path includes a first wind tunnel portion positioned below the upstream side impeller to extend in a circumferential direction and arranged to receive a gas stream from the upstream side impeller and a second wind tunnel portion positioned above the downstream side impeller to extend in the circumferential direction and arranged to receive a gas stream from the downstream side impeller.

17 Claims, 9 Drawing Sheets

CENTRIFUGAL FAN

BACKGROUND OF THE INVENTION

1. Field of the Invention

The present invention relates to a centrifugal fan.

2. Description of the Related Art

A centrifugal fan for generating an airflow through the use of an impeller is known in the art. For example, Japanese Patent Application Publication No. 2009-537735 discloses a conventional centrifugal blower including three impellers and an electric motor. In this blower, the motor, the impellers, the inlet port and the outlet port are arranged in a coaxial relationship.

The inlet port is arranged at one end portion of the substantially cylindrical blower and the outlet port is arranged at the other end thereof. Air is sent from the inlet port to the outlet port through three stages arranged along an axis. The air is accelerated in the respective stages and is forwarded from the impellers toward the downstream side through a radial outer region. However, with this structure, it is difficult to reduce the size of the blower. In medical devices such as, for example, in an artificial respirator and an expectoration assist device, it is desirable to reduce the size of a blower from the viewpoint of portability.

Static pressure is one of the indices of a performance level of a centrifugal fan. In order to increase the static pressure, it is possible to increase the revolution number of a motor or to lengthen the flow path within a housing. In case of increasing the revolution number of a motor, it is however necessary to take countermeasures against heat generation. If an attempt is made to merely lengthen the flow path in the blower of Japanese Patent Application Publication No. 2009-537735, the axial dimension of the blower grows quite larger. In medical devices such as, for example, an artificial respirator and an expectoration assist device, it is required to increase the static pressure while also reducing the size of a blower.

SUMMARY OF THE INVENTION

Preferred embodiments of the present invention provide a centrifugal fan having a reduced size and axial dimension and increased static pressure.

According to a first preferred embodiment of the present invention, a centrifugal fan includes an upstream side impeller arranged to rotate about a center axis extending in an axial direction; a downstream side impeller positioned below the upstream side impeller and arranged to rotate about the center axis; a motor arranged to rotate the upstream side impeller and the downstream side impeller; and a housing arranged to accommodate the upstream side impeller, the downstream side impeller and the motor, wherein the housing includes a first intake port through which a gas is drawn from the outside, an exhaust port through which the gas is discharged to the outside, and a flow path defined within the housing to bring the first intake port and the exhaust port into communication with each other, the flow path including a first wind tunnel portion positioned below the upstream side impeller to extend in a circumferential direction and arranged to receive a gas stream from the upstream side impeller and a second wind tunnel portion positioned above the downstream side impeller to extend in the circumferential direction and arranged to receive a gas stream from the downstream side impeller.

According to a second preferred embodiment of the present invention, a centrifugal fan includes an upstream side impeller arranged to rotate about a center axis extending in an axial direction; a downstream side impeller positioned below the upstream side impeller and arranged to rotate about the center axis; a motor arranged to rotate the upstream side impeller and the downstream side impeller; and a housing arranged to accommodate the upstream side impeller, the downstream side impeller and the motor, wherein the housing includes an intake port through which a gas is drawn from the outside, an exhaust port through which the gas is discharged to the outside, and a flow path defined within the housing to bring the intake port and the exhaust port into communication with each other, the flow path including an intermediate arc-shaped portion arranged below the upstream side impeller and above the downstream side impeller to extend in circumferential direction.

With the first preferred embodiment of the present invention, it is possible to reduce the radial dimension of the centrifugal fan as compared with a case where the first wind tunnel portion and the second wind tunnel portion are arranged radially outward of the respective impellers. Since the second wind tunnel portion is arranged above the downstream side impeller, it is possible to shorten the axial distance between the first intake port and the exhaust port. This makes it possible to reduce the size of the centrifugal fan.

With the second preferred embodiment of the present invention, the intermediate arc-shaped portion extending in the circumferential direction makes it possible to lengthen the flow path defined within the housing while also reducing the axial dimension of the centrifugal fan. This makes it possible to increase the static pressure.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
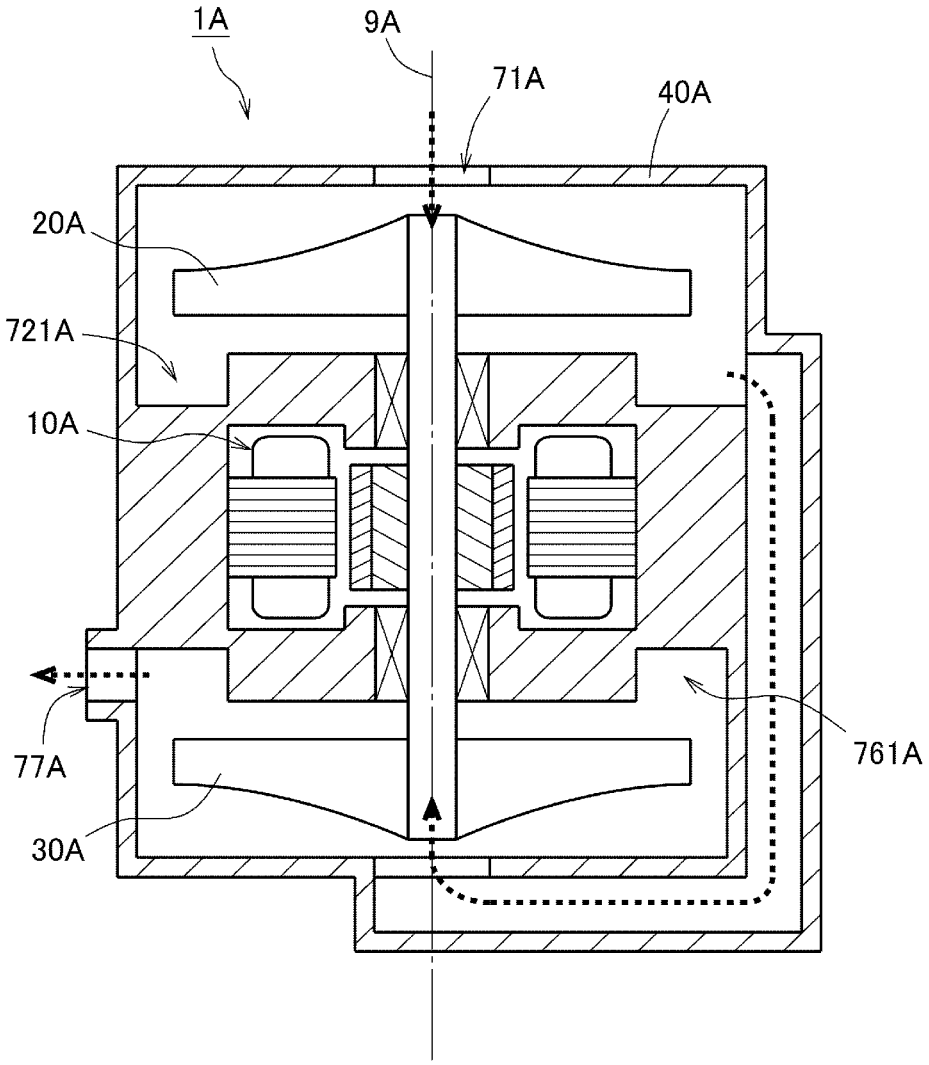
FIG. 1 is a vertical section view showing a centrifugal fan according to a first preferred embodiment of the present invention.

In the following description, the shape and positional relationship of individual components will be described under the assumption that the upper side and the lower side shown in FIG. 1 is the upper side and the lower side, the direction parallel or substantially parallel to the center axis is an axial direction, the direction perpendicular or substantially perpendicular to the center axis is a radial direction, and the direction circumferential to the center axis is a circumferential direction. However, this definition is provided merely for the sake of convenience in description and is not intended to limit the direction when the present centrifugal fan is used.

First Preferred Embodiment

FIG. 1 is a vertical section view showing a centrifugal fan 1A according to a first preferred embodiment of the present invention. Referring to FIG. 1, the centrifugal fan 1A preferably includes a motor 10A, an upstream side impeller 20A, a downstream side impeller 30A, and a housing 40A. The motor 10A, the upstream side impeller 20A, and the downstream side impeller 30A are accommodated within the housing 40A. The downstream side impeller 30A is arranged below the upstream side impeller 20A. The upstream side impeller 20A and the downstream side impeller 30A are rotated about a center axis 9A by the motor 10A.

The housing 40A preferably includes a first intake port 71A through which a gas (such as, for example, air, oxygen, nitrogen, etc.) is drawn from the outside and an exhaust port 77A through which the gas is discharged to the outside. A flow path to bring the first intake port 71A and the exhaust port 77A into communication with each other is provided inside the housing 40A. The flow path preferably includes a first wind tunnel portion 721A and a second wind tunnel portion 761A. The first wind tunnel portion 721A is arranged to receive a gas stream from the upstream side impeller 20A. The second wind tunnel portion 761A is arranged to receive a gas stream from the downstream side impeller 30A.

As shown in FIG. 1, the first wind tunnel portion 721A of the centrifugal fan 1A is arranged below the upstream side impeller 20A to extend in the circumferential direction. The second wind tunnel portion 761A is arranged above the downstream side impeller 30A to extend in the circumferential direction. Therefore, as compared with a case where the first wind tunnel portion 721A and the second wind tunnel portion 761A are arranged radially outward of the respective impellers 20A and 30A, it is possible to reduce the radial dimension of the centrifugal fan 1A. Additionally, since the second wind tunnel portion 761A is arranged above the downstream side impeller 30A, it is possible to shorten the axial distance between the first intake port 71A and the exhaust port 77A. This makes it possible to reduce the overall size of the centrifugal fan 1A.

Second Preferred Embodiment

Figure 2:
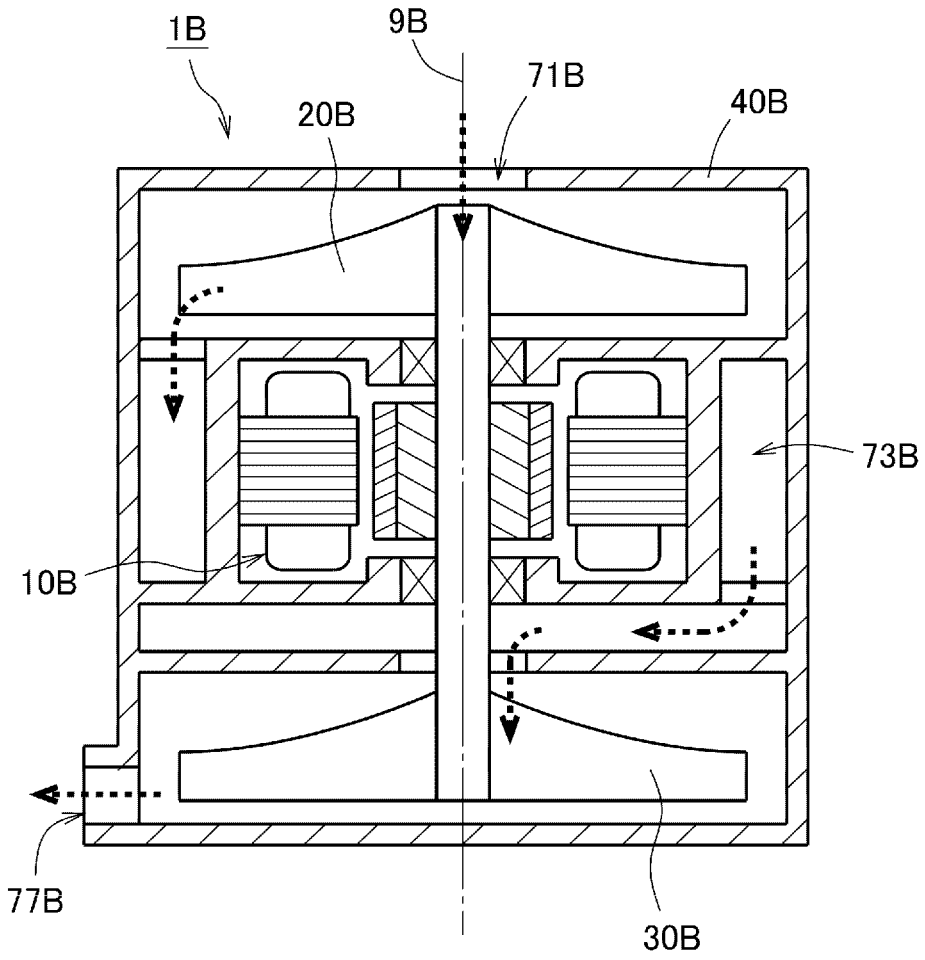
FIG. 2 is a vertical section view showing a centrifugal fan according to a second preferred embodiment of the present invention.

FIG. 2 is a vertical section view showing a centrifugal fan 1B according to a second preferred embodiment of the present invention. Referring to FIG. 2, the centrifugal fan 1B preferably includes a motor 10B, an upstream side impeller 20B, a downstream side impeller 30B, and a housing 40B. The motor 10B, the upstream side impeller 20B and the downstream side impeller 30B are accommodated within the housing 40B. The downstream side impeller 30B is arranged below the upstream side impeller 20B. The upstream side impeller 20B and the downstream side impeller 30B are rotated about a center axis 9B by the motor 10B.

The housing 40B preferably includes a first intake port 71B through which a gas (such as, for example, air, oxygen, nitrogen, etc.) is drawn from the outside and an exhaust port 77B through which the gas is discharged to the outside. A flow path to bring the first intake port 71B and the exhaust port 77B into communication with each other is provided inside the housing 40B. The flow path preferably includes an intermediate arc-shaped portion 73B arranged below the upstream side impeller 20B and above the downstream side impeller 30B to extend in the circumferential direction.

Provision of the intermediate arc-shaped portion 73B makes it possible to lengthen the flow path defined within the housing 40B while reducing the axial dimension of the centrifugal fan 1B. Accordingly, it is possible to increase the static pressure within the centrifugal fan 1B.

Third Preferred Embodiment

Figure 3:
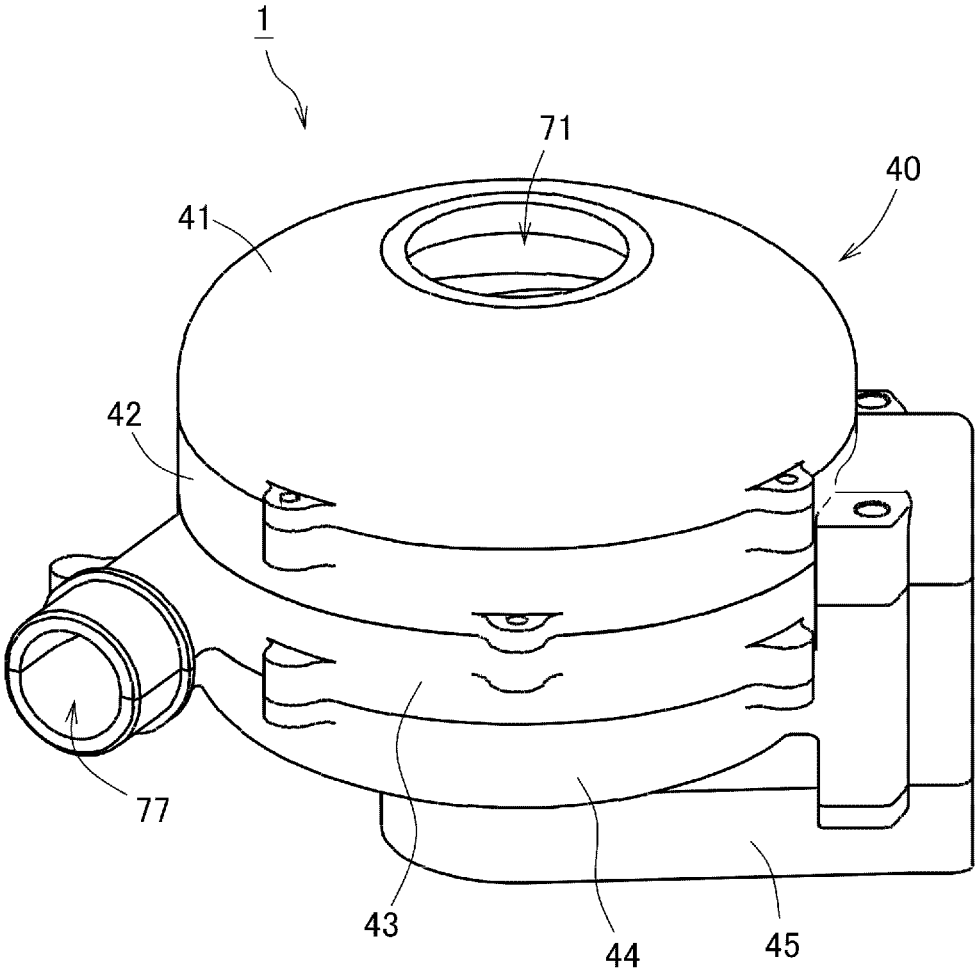
FIG. 3 is a perspective view showing a centrifugal fan according to a third preferred embodiment of the present invention.
Figure 4:
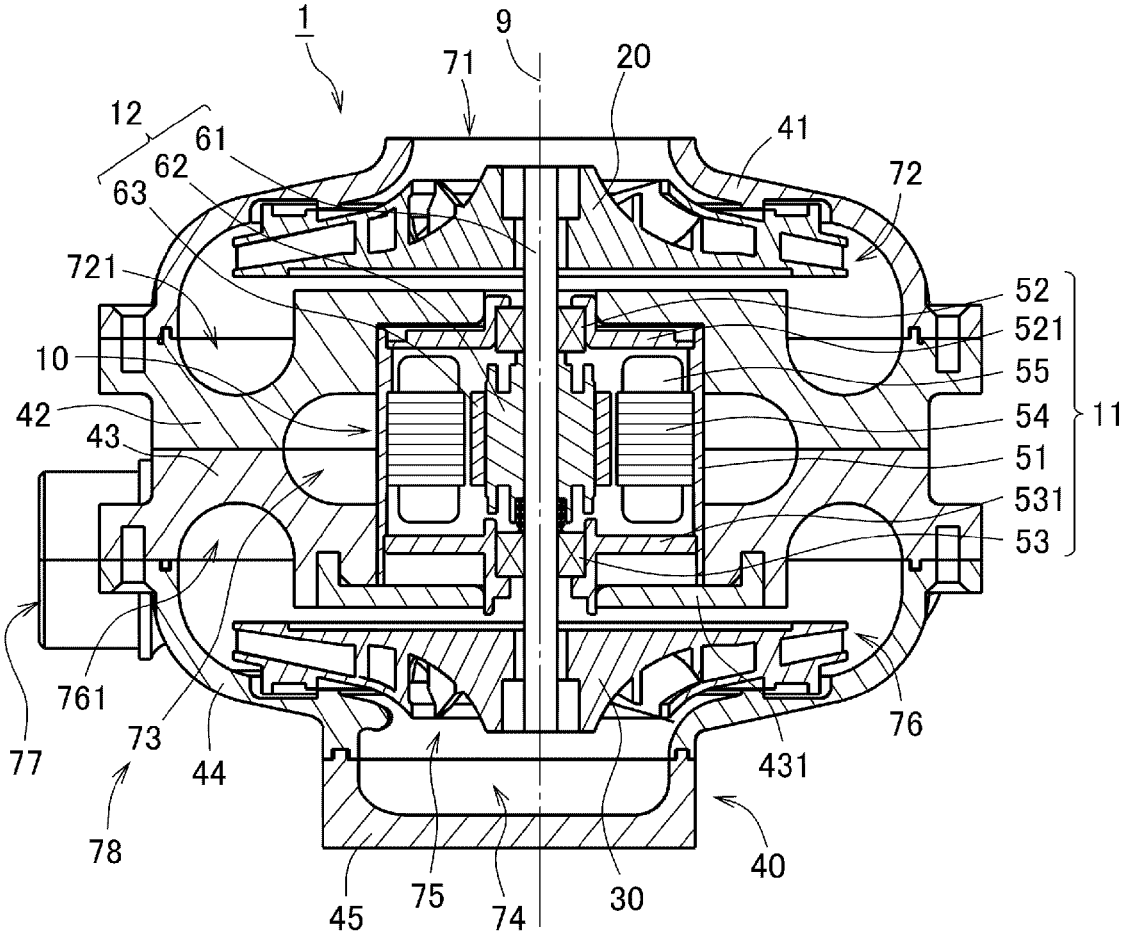
FIG. 4 is a vertical section view of the centrifugal fan shown in FIG. 3.

FIG. 3 is a perspective view showing a centrifugal fan according to a third preferred embodiment of the present invention. FIG. 4 is a vertical section view of the centrifugal fan 1 shown in FIG. 3.

Referring to FIGS. 3 and 4, the centrifugal fan 1 of the present preferred embodiment preferably includes a motor 10, an upstream side impeller 20, a downstream side impeller 30, and a housing 40.

The motor 10 is preferably an inner-rotor-type motor arranged to rotate the upstream side impeller 20 and the downstream side impeller 30. The motor 10 preferably includes a stationary unit 11 and a rotary unit 12 arranged inside the stationary unit 11. The stationary unit 11 is preferably fixed to the housing 40. The rotary unit 12 is supported to make rotation with respect to the stationary unit 11.

The stationary unit 11 is arranged below the upstream side impeller 20 and above the downstream side impeller 30. In the present preferred embodiment, the stationary unit 11 preferably includes a case 51, an upper bearing unit 52, a lower bearing unit 53, a stator core 54, and coils 55.

The case 51 is preferably a substantially cylindrical motor holding member. The upper bearing unit 52, the lower bearing unit 53, the stator core 54 and the coils 55 are accommodated within the case 51. The case 51 is preferably made of metal, e.g., aluminum alloy, iron alloy, brass, or other suitable material. The case 51 is arranged inside a first connecting member 42 and a second connecting member 43 to be set forth later. A fixing member 431 arranged to support the lower end portion of the case 51 is fixed to the lower portion of the second connecting member 43.

The upper bearing unit 52 is fixed to around the upper end portion of the case 51 through an upper bearing holding member 521. The lower bearing unit 53 is fixed to around the lower end portion of the case 51 through a lower bearing holding member 531. For example, ball bearings each having an outer race and an inner race which can make rotation relative to each other with balls interposed therebetween are used as the upper bearing unit 52 and the lower bearing unit 53. Alternatively, other bearings such as plain bearings may be used as the upper bearing unit 52 and the lower bearing unit 53.

The stator core 54 and the coils 55 are arranged to generate magnetic flux as a drive current is supplied thereto. The stator core 54 is preferably formed by, e.g., stacking electromagnetic steel plates one above another along the axial direction. However, any other desirable stator forming method could be used instead. The stator core 54 is preferably fixed to the inner circumferential surface of the case 51. The stator core 54 preferably includes a plurality of teeth protruding radially inward. The coils 55 are preferably defined by electrically conductive wires wound around the plurality of teeth.

In the present preferred embodiment, the rotary unit 12 preferably includes a shaft 61, a rotor core 62, and magnets 63.

The shaft 61 is a substantially cylindrical columnar member extending along the center axis 9. The shaft 61 is supported by the upper bearing unit 52 and the lower bearing unit to be rotatable about the center axis 9. The upper end portion of the shaft 61 preferably extends upward beyond the upper bearing unit 52. The upstream side impeller 20 is fixed to the upper end portion of the shaft 61. The lower end portion of the shaft 61 extends downward beyond the lower bearing unit 53. The downstream side impeller 30 is fixed to the lower end portion of the shaft 61.

The rotor core 62 is preferably fixed to the shaft 61 at a position between the upper bearing unit 52 and the lower bearing unit 53. The rotor core 62 preferably has a substantially cylindrical outer circumferential surface. The magnets 63 are fixed to the outer circumferential surface of the rotor core 62. The radial outer surfaces of the magnets 63 are radially opposed to the radial inner end surfaces of the teeth. The radial outer surfaces of the magnets 63 are alternately magnetized with N-poles and S-poles arranged along the circumferential direction.

In the motor 10, if a drive current is applied to the coils 55, radial magnetic flux is generated in the teeth of the stator core 54. Circumferential torque is generated by the magnetic flux acting between the teeth and the magnets 63. As a result, the rotary unit 12 is rotated about the center axis 9 with respect to the stationary unit 11. The upstream side impeller 20 and the downstream side impeller 30 fixed to the shaft 61 are rotated about the center axis 9 together with the shaft 61.

Each of the upstream side impeller 20 and the downstream side impeller 30 is preferably a substantially disc-shaped member extending in the radial direction. The upstream side impeller 20 and the downstream side impeller 30 are preferably made of a resin material, e.g., PBT (polybutylene terephthalate), PC (polycarbonate), etc. Alternatively, the upstream side impeller 20 and the downstream side impeller 30 may be made of a material other than resin, for example, metal, a composite, etc. Each of the upstream side impeller 20 and the downstream side impeller 30 has a plurality of blades. If the upstream side impeller 20 and the downstream side impeller 30 are rotated, a gas (such as, for example, air, oxygen, nitrogen, etc.) is accelerated in the tangential direction of the outer edge portions of the blade. As a consequence, gas streams moving away from the center axis 9 are generated near the respective impellers 20 and 30.

The centrifugal fan 1 generates gas streams within the housing 40 through the use of the two impellers 20 and 30. It is therefore possible to obtain a high static pressure with the revolution number equal to that of a fan having a single impeller. In other words, the centrifugal fan 1 can obtain an equal or substantially equal static pressure with the revolution number smaller than that of a fan having a single impeller. If the revolution number of the motor 10 becomes smaller, it is possible to reduce noises and vibrations when driving the centrifugal fan 1.

Figure 5:
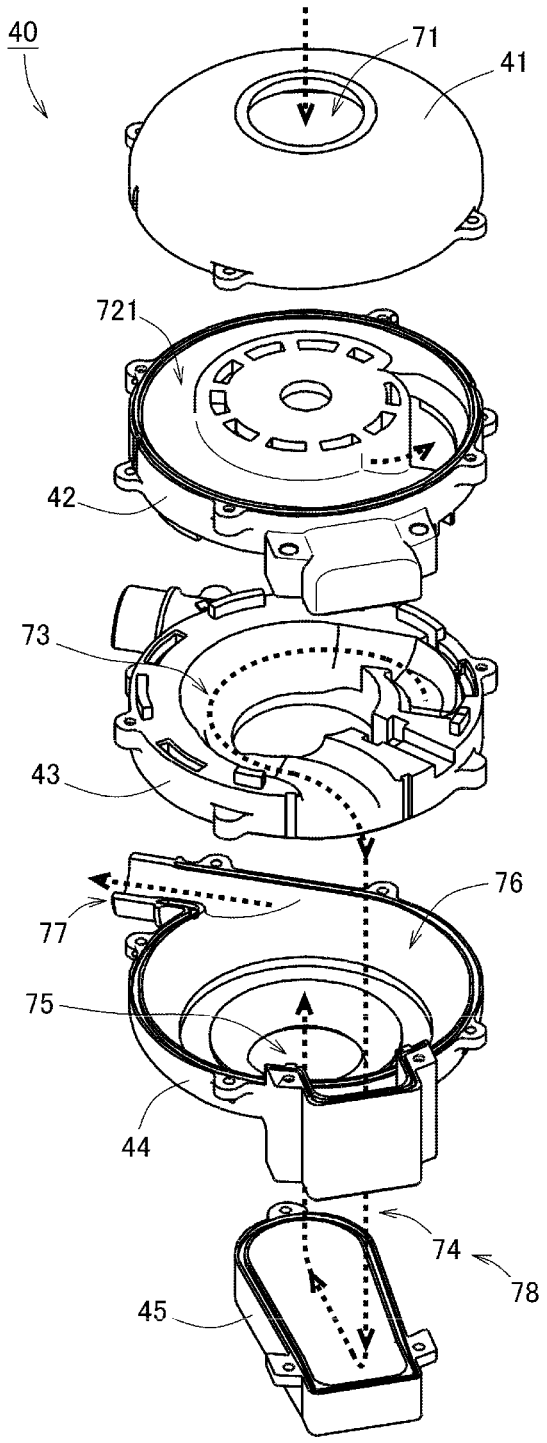
FIG. 5 is an exploded perspective view of the housing of the centrifugal fan shown in FIG. 3.

The motor 10, the upstream side impeller 20 and the downstream side impeller 30 are accommodated within the housing 40. FIG. 5 is a perspective view of the housing 40. As shown in FIGS. 3 through 5, the housing 40 of the present preferred embodiment preferably includes an upper cover member 41, a first connecting member 42, a second connecting member 43, a lower cover member 44, and a bottom member 45.

The respective members 41 through 45 that define the housing 40 are preferably made of a resin material, e.g., PBT (polybutylene terephthalate), PC (polycarbonate), etc. Alternatively, the respective members 41 through 45 of the housing 40 may be made of a material other than the resin, for example, metal, a composite, etc. The respective members 41 through 45 are fixed to one another preferably by a screw-fixing method, an engaging method, etc. Sealing materials (not shown) preferably made of an elastomer are interposed between the respective members 41 through 45. The sealing materials prevent leakage of a gas from the gaps defined between the respective members 41 through 45.

The upper cover member 41 is preferably an annular member arranged to cover the outer peripheral portion of the upstream side impeller 20. The upper cover member 41 preferably extends in a curved surface shape so that the diameter thereof grows larger as it extends downward. A first intake port 71, through which a gas is drawn from the outside, is preferably defined at the center of the upper cover member 41. The first intake port 71 is preferably arranged above the central portion of the upstream side impeller 20.

The first connecting member 42 is preferably an annular member arranged below the upper cover member 41. A first impeller chamber 72 arranged to accommodate the upstream side impeller 20 is defined between the upper cover member 41 and the first connecting member 42. In the present preferred embodiment, the lower surface of the upper cover member 41 preferably defines an upper interface of the first impeller chamber 72. The upper surface of the first connecting member 42 preferably defines a lower interface of the first impeller chamber 72.

The first impeller chamber 72 preferably includes a first wind tunnel portion 721 arranged below the upstream side impeller 20 to extend in the circumferential direction. The first wind tunnel portion 721 is preferably defined by an arc-shaped groove formed on the upper surface of the first connecting member 42. In the present preferred embodiment, as shown in FIG. 4, the radial outer edge portion of the upstream side impeller 20 is positioned a little radially outward of the radial middle portion of the first wind tunnel portion 721.

If the upstream side impeller 20 is rotated, a gas is drawn into the first impeller chamber 72 from the first intake port 71. The gas drawn into the first impeller chamber 72 is sent to the first wind tunnel portion 721 via the central portion and the outer peripheral portion of the upstream side impeller 20.

The second connecting member 43 is preferably an annular member arranged below the first connecting member 42. An intermediate arc-shaped portion 73 extending circumferentially along the outer circumferential surface of the motor 10 is preferably provided between the first connecting member 42 and the second connecting member 43. In the present preferred embodiment, a groove arranged on the lower surface of the first connecting member 42 preferably defines an upper interface of the intermediate arc-shaped portion 73. A groove arranged on the upper surface of the second connecting member 43 preferably defines a lower interface of the intermediate arc-shaped portion 73.

The intermediate arc-shaped portion 73 is preferably a portion of a connecting flow path 78 that interconnects the first impeller chamber 72 and the second impeller chamber 76 to be described later. The upstream end of the intermediate arc-shaped portion 73 communicates with the first wind tunnel portion 721. The downstream end of the intermediate arc-shaped portion 73 communicates with the bypass flow path 74 to be set forth later.

The intermediate arc-shaped portion 73 extends circumferentially in between the first impeller chamber 72 and the second impeller chamber 76. The intermediate arc-shaped portion 73 makes it possible to lengthen the flow path defined within the housing 40 while reducing the axial length of the centrifugal fan 1. If the flow path within the housing 40 is lengthened in this manner, it is possible to increase the static pressure of the centrifugal fan 1. Thus, it is much harder for a backflow of a gas to occur.

In the present preferred embodiment, the outer circumferential surface of the case 51 of the motor 10 is exposed to the intermediate arc-shaped portion 73. Therefore, the heat generated by the operation of the motor 10 is dissipated from the case 51 to the gas existing within the intermediate arc-shaped portion 73. In other words, the motor 10 is cooled by the gas stream flowing through the intermediate arc-shaped portion 73. This makes it possible to restrain the motor 10 from being overheated during the operation thereof. If the overheating of the motor 10 is restrained, it is possible to prevent degradation of the motor 10 and degradation of the upper bearing unit 52 and the lower bearing unit 53 arranged near the motor 10.

In the present preferred embodiment, the case 51 made of metal is higher in heat conductivity than a resin-made case. This makes it possible to efficiently cool the case 51. As shown in FIG. 4, a portion of the outer circumferential surface of the case 51 is exposed to the intermediate arc-shaped portion 73. Alternatively, the entire outer circumferential surface of the case 51 may be exposed to the intermediate arc-shaped portion 73 if so desired.

In the present preferred embodiment, the intermediate arc-shaped portion 73 extends in the circumferential direction at a substantially constant height. Alternatively, the intermediate arc-shaped portion 73 may extend helically to have a gradually decreasing height if so desired. However, if the intermediate arc-shaped portion 73 is formed into a helical shape, the length of the intermediate arc-shaped portion 73 becomes larger in the axial direction. In the present preferred embodiment, therefore, the intermediate arc-shaped portion 73 is arranged around the case 51 over an extent of more than one half of the perimeter of the case 51 and less than the perimeter of the case 51. This makes it possible to broaden the exposed surface of the case 51 while reducing the axial dimension of the intermediate arc-shaped portion 73.

The downstream end of the intermediate arc-shaped portion 73 and the second impeller chamber 76 are connected through a bypass flow path 74. The bypass flow path 74 is arranged to guide the gas flowing out from the intermediate arc-shaped portion 73 toward the lower region of the second impeller chamber 76 through a passageway arranged radially outward of the second impeller chamber 76. In the present preferred embodiment, the bypass flow path 74 and the intermediate arc-shaped portion define the connecting flow path 78 that interconnects the first impeller chamber 72 and the second impeller chamber 76. As shown in FIGS. 3 through 5, the bypass flow path 74 of the present preferred embodiment is defined by the first connecting member 42, the second connecting member 43, the lower cover member 44, and the bottom member 45.

The lower cover member 44 is an annular member arranged to cover the outer peripheral portion of the downstream side impeller 30. The lower cover member 44 extends in a curved surface shape so that the diameter thereof grows smaller as it extends downward. A second intake port 75, through which the gas is drawn from the connecting flow path 78, is provided at the center of the lower cover member 44. The second intake port 75 is arranged below the central portion of the downstream side impeller 30.

The second impeller chamber 76 arranged to accommodate of the downstream side impeller 30 is provided between the second connecting member 43 and the lower cover member 44. In the present preferred embodiment, the lower surface of the second connecting member 43 preferably defines an upper interface of the second impeller chamber 76. The upper surface of the lower cover member 44 preferably defines a lower interface of the second impeller chamber 76.

The second impeller chamber 76 preferably includes a second wind tunnel portion 761 arranged above the downstream side impeller 30 to extend in the circumferential direction. The second wind tunnel portion 761 is defined by an arc-shaped groove arranged on the lower surface of the second connecting member 43. In the present preferred embodiment, as shown in FIG. 4, the radial outer edge portion of the downstream side impeller 30 is positioned a little radially outward of the radial middle portion of the second wind tunnel portion 761.

An exhaust port 77, through which the gas is discharged toward the outside of the housing 40, is provided at one side of the second wind tunnel portion 761. The exhaust port 77 is opened in the tangential direction. As shown in FIGS. 3 through 5, the exhaust port 77 of the present preferred embodiment is defined by the second connecting member 43 and the lower cover member 44.

If the downstream side impeller 30 is rotated, the gas is drawn into the second impeller chamber 76 from the second intake port 75. The gas drawn into the second impeller chamber 76 is sent to the second wind tunnel portion 761 via the central portion and the outer peripheral portion of the downstream side impeller 30 and is discharged to the outside of the housing 40 through the exhaust port 77.

As set forth above, a flow path including the first impeller chamber 72, the intermediate arc-shaped portion 73, the bypass flow path 74, and the second impeller chamber 76 is defined within the housing 40. Upon driving the motor 10, the upstream side impeller 20 and the downstream side impeller 30 are rotated to generate a gas stream flowing from the first intake port 71 toward the exhaust port 77 through the flow path defined within the housing 40.

In the centrifugal fan 1, the upstream side impeller 20 and the downstream side impeller 30 preferably have a mirror symmetry shape with respect to each other. The upstream side impeller 20 and the downstream side impeller 30 are preferably arranged in a vertically inverted posture with respect to each other. This ensures that the pressure generated by the upstream side impeller 20 is equal or substantially equal to the pressure generated by the downstream side impeller 30. Thus the gas stream within the housing 40 becomes stable.

In the present preferred embodiment, the first wind tunnel portion 721 is preferably arranged below the upstream side impeller 20 and the second wind tunnel portion 761 is preferably arranged above the downstream side impeller 30. Therefore, as compared with a case where the wind tunnel portions 721 and 761 are arranged radially outward of the impellers 20 and 30, it is possible to reduce the radial dimension of the centrifugal fan 1.

In the present preferred embodiment, the second wind tunnel portion 761 and the exhaust port 77 are arranged higher than the downstream side impeller 30. Therefore, as compared with a case where the second wind tunnel portion 761 and the exhaust port 77 are arranged lower than the downstream side impeller 30, it is possible to shorten the axial distance between the first intake port 71 and the exhaust port 77. This makes it possible to reduce the size of the centrifugal fan 1 and the medical device provided with the centrifugal fan 1.

In the present preferred embodiment, each of the first impeller chamber 72, the intermediate arc-shaped portion 73, and the second impeller chamber 76 is preferably defined between two members arranged one above the other. This makes it possible to easily manufacture the respective members 41 through 45 preferably by, for example, injection molding through the use of molds. In particular, the first connecting member 42 is arranged to define both the first impeller chamber 72 and the intermediate arc-shaped portion 73. The second connecting member 43 is arranged to define both the intermediate arc-shaped portion 73 and the second impeller chamber 76. This makes it possible to reduce the number of members defining the housing 40.

Figure 6:
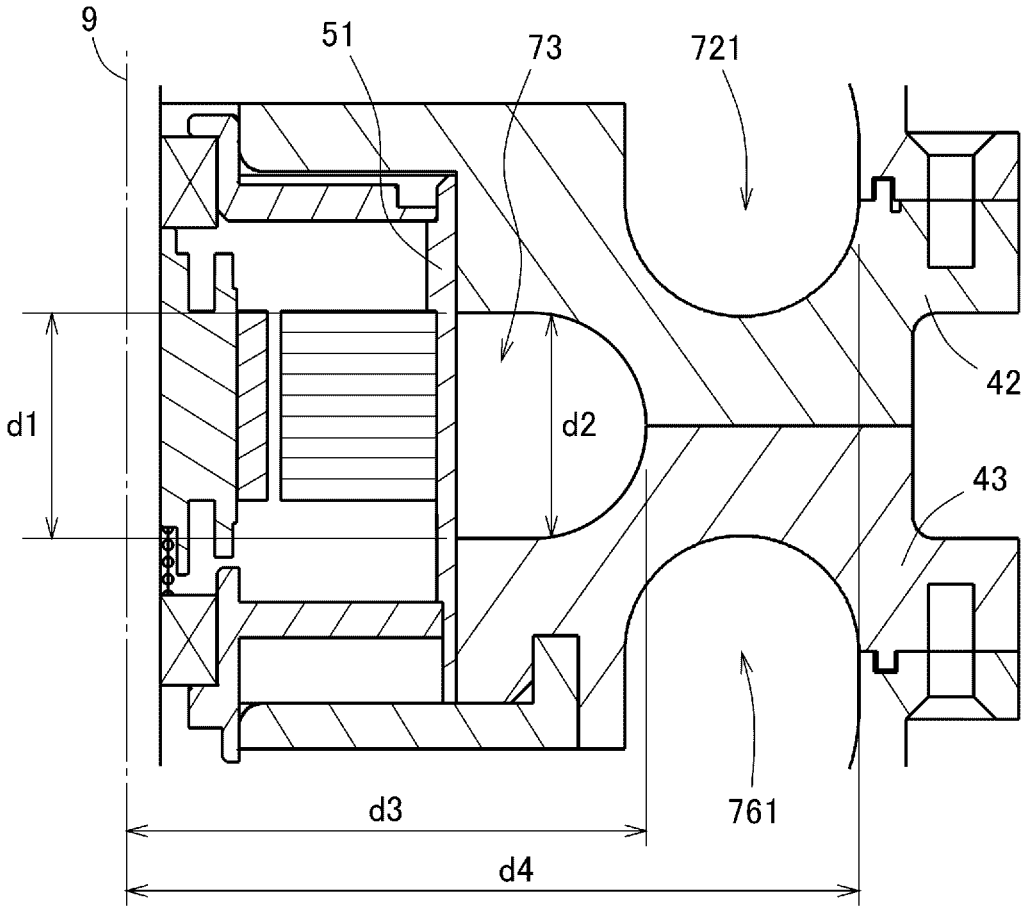
FIG. 6 is a partially-enlarged vertical section view of the centrifugal fan shown in FIG. 3.

FIG. 6 is a partially-enlarged vertical section view showing the intermediate arc-shaped portion 73 and its vicinities. As shown in FIG. 6, the intermediate arc-shaped portion 73 is preferably opened toward the outer circumferential surface of the motor 10. In the present preferred embodiment, the axial dimension d1 of the inner peripheral portion of the intermediate arc-shaped portion 73 is equal to or greater than the axial dimension d2 of the radial middle portion of the intermediate arc-shaped portion 73. This makes it possible to increase the exposed surface of the case 51. Accordingly, it is possible to efficiently cool the motor 10.

In the present preferred embodiment, the outermost diameter d3 of the intermediate arc-shaped portion 73 is preferably smaller than the outermost diameter d4 of the first impeller chamber 72 and the second impeller chamber 76. This makes it possible to have the first wind tunnel portion 721 and the second wind tunnel portion 761 come closer to each other. Accordingly, it is possible to reduce the size of the centrifugal fan 1.

In the present preferred embodiment, the area of the cross section of the intermediate arc-shaped portion 73 orthogonal to the circumferential direction is preferably smaller than the area of the cross section of each of the first wind tunnel portion 721 and the second wind tunnel portion 761 orthogonal to the circumferential direction. This makes it possible to increase the static pressure within the intermediate arc-shaped portion 73. Accordingly, it is possible to further restrain backflow of the gas within the intermediate arc-shaped portion 73.

Figure 7:
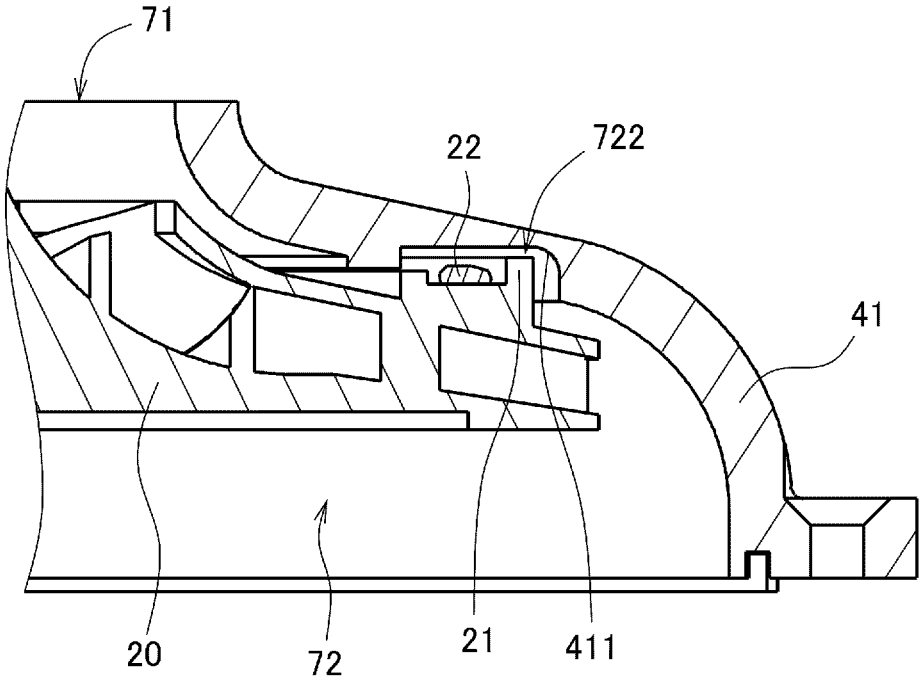
FIG. 7 is a partially-enlarged vertical section view of the upstream side impeller and the upper cover member of the centrifugal fan.

FIG. 7 is a partially-enlarged vertical section view showing the upstream side impeller 20 and the upper cover member 41. As shown in FIG. 7, a first annular protrusion 21 protruding upward is defined on the upper surface of the upstream side impeller 20. A first annular groove 411 corresponding to the first annular protrusion 21 is defined on the lower surface of the upper cover member 41. The upper end portion of the first annular protrusion 21 is arranged within the first annular groove 411. A first labyrinth portion 722 including a reduced clearance is defined between the first annular protrusion 21 and the first annular groove 411.

The gas drawn into the first impeller chamber 72 from the first intake port 71 is sent to the outer peripheral portion of the upstream side impeller 20 through the first labyrinth portion 722. Since the first labyrinth portion 722 has an increased flow resistance, it is hard for the gas flowing out from the first labyrinth portion 722 to flow back toward the first intake port 71. This further increases the static pressure within the housing 40.

Figure 8:
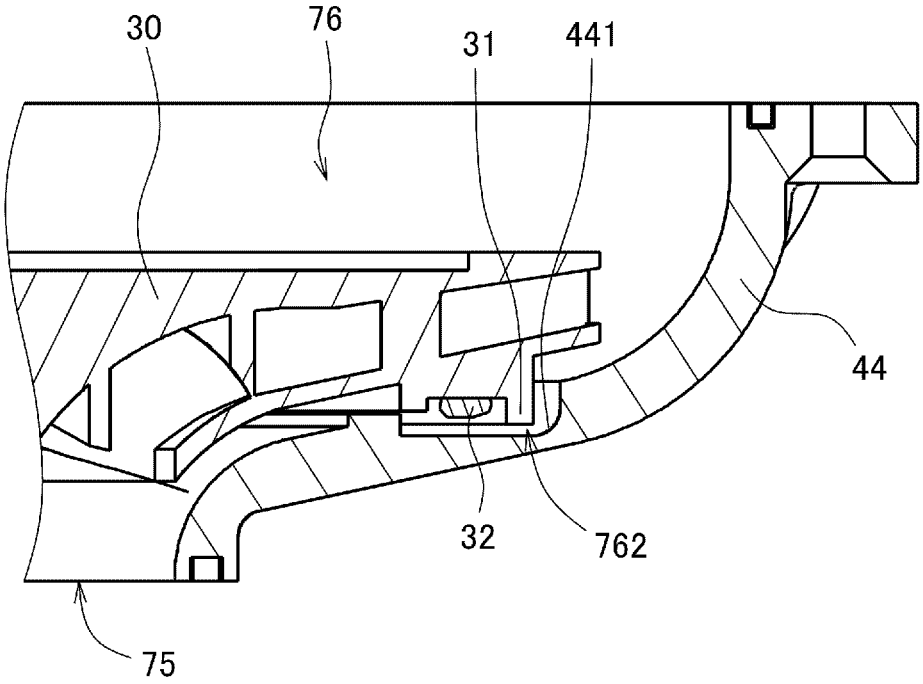
FIG. 8 is a partially-enlarged vertical section view of the downstream side impeller and the lower cover member of the centrifugal fan.

FIG. 8 is a partially-enlarged vertical section view showing the downstream side impeller 30 and the lower cover member 44. As shown in FIG. 8, a second annular protrusion 31 protruding downward is defined on the lower surface of the downstream side impeller 30. A second annular groove 441 corresponding to the second annular protrusion 31 is defined on the upper surface of the lower cover member 44. The lower end portion of the second annular protrusion 31 is arranged within the second annular groove 441. A second labyrinth portion 762 having a reduced clearance is defined between the second annular protrusion 31 and the second annular groove 441.

The gas drawn into the second impeller chamber 76 from the second intake port 75 is sent to the outer peripheral portion of the downstream side impeller 30 through the second labyrinth portion 762. Since the second labyrinth portion 762 has an increased flow resistance, it is hard for the gas flowing out from the second labyrinth portion 762 to flow back toward the second intake port 75. This further increases the static pressure within the housing 40.

It is sometimes the case that the center positions of the upstream side impeller 20 and the downstream side impeller 30 are not coaxial with the center axis 9 because of non-uniformity in shape and materials of the impellers 20 and 30. In this case, balancing members arranged to correct the center positions may be attached to the upstream side impeller 20 and the downstream side impeller 30. In of the example shown in FIG. 7, a balancing member 22 is attached to a recess portion on the upper surface of the upstream side impeller 20 near the first annular protrusion 21. In the example shown in FIG. 8, a balancing member 32 is attached to a recess portion formed beneath the lower surface of the downstream side impeller 30 near the second annular protrusion 31.

While certain preferred embodiments of the present invention have been described above, the present invention is not limited to these preferred embodiments.

Figure 9:
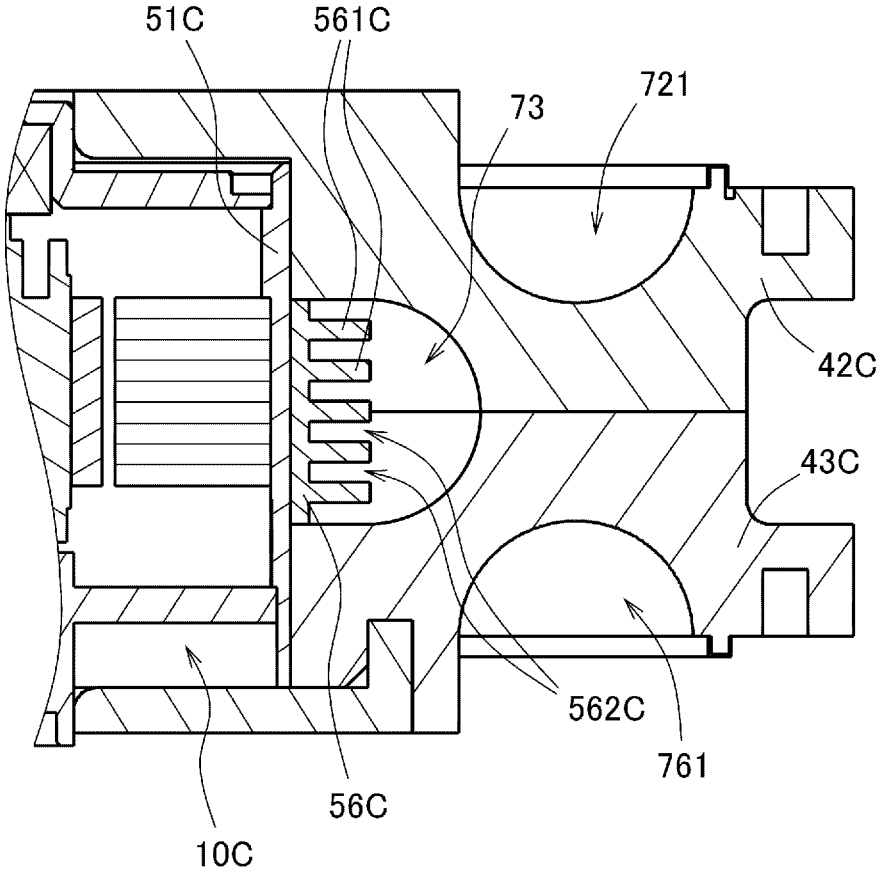
FIG. 9 is a partially-enlarged vertical section view of the motor, the first connecting member and the second connecting member of the centrifugal fan shown in FIG. 3.

FIG. 9 is a partially-enlarged vertical section view showing a motor 10C, a first connecting member 42C and a second connecting member 43C according to one modified example. As shown in FIG. 9, a heat sink 56C may be attached to the outer circumferential surface of the case 51C of the motor 10C. The heat sink 56C is preferably made of a material having a large heat conductivity, e.g., aluminum, copper, etc. The heat sink 56C shown in FIG. 9 preferably includes a plurality of fins 561C protruding radially outward. Thus, the heat sink 56C makes contact over an increased area with the gas stream flowing through the intermediate arc-shaped portion 73C. Accordingly, the motor 10C is cooled in a more efficient manner.

In the example shown in FIG. 9, circumferentially-extending gaps 562C are defined between the fins 561C. The gas flows through the gaps 562C in the circumferential direction. This enables the gas stream and the fins 561C to make contact with each other in an efficient manner. Accordingly, it is possible to further enhance the cooling efficiency of the motor 10C.

The number of members defining the housing may differ from the one described in respect of the foregoing preferred embodiments. Likewise, the dimensions and detailed shapes of the respective parts are not limited to the ones of the foregoing preferred embodiments.

The upstream side impeller and the downstream side impeller may alternatively not be defined to have a mirror symmetry shape but may instead have different shapes, if so desired. The centrifugal fan may further include an impeller other than the upstream side impeller and the downstream side impeller.

The individual components employed in the foregoing preferred embodiments and modified examples may be arbitrarily combined unless contradictory and/or incompatible with one another.

Various preferred embodiments of the present invention can be applied to a centrifugal fan mounted to, e.g., a medical device, an OA device or a home appliance.

While various preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A centrifugal fan, comprising:

an upstream side impeller arranged to rotate about a center axis extending in an axial direction;

a downstream side impeller positioned below the upstream side impeller and arranged to rotate about the center axis;

a motor arranged to rotate the upstream side impeller and the downstream side impeller; and a housing arranged to accommodate the upstream side impeller, the downstream side impeller, and the motor; wherein the housing includes:

a first intake port through which a gas is drawn from outside;

an exhaust port through which the gas is discharged to the outside; and a flow path defined within the housing to bring the first intake port and the exhaust port into communication with each other;

the flow path includes a first wind tunnel portion positioned below the upstream side impeller to extend in a circumferential direction and arranged to receive a gas stream from the upstream side impeller and a second wind tunnel portion positioned above the downstream side impeller to extend in the circumferential direction and arranged to receive a gas stream from the downstream side impeller;

the flow path includes:

a first impeller chamber arranged to accommodate the upstream side impeller;

a second impeller chamber arranged to accommodate the downstream side impeller; and a connecting flow path arranged to interconnect the first impeller chamber and the second impeller chamber;

the first intake port is positioned above the upstream side impeller;

the housing further includes a second intake port arranged between the connecting flow path and the second impeller chamber;

the second intake port is positioned below the downstream side impeller;

the connecting flow path includes an intermediate arc-shaped portion positioned below the first impeller chamber and above the second impeller chamber, the intermediate arc-shaped portion extends in the circumferential direction; and the intermediate arc-shaped portion includes an outermost diameter smaller than an outermost diameter of each of the first impeller chamber and the second impeller chamber.

2. The centrifugal fan of claim 1, wherein the intermediate arc-shaped portion is defined around the motor over an extent of more than one half of a perimeter of the motor and less than the perimeter of the motor.

3. The centrifugal fan of claim 1, wherein the motor is arranged below the upstream side impeller and above the downstream side impeller, the motor including an outer circumferential surface at least partially exposed to the intermediate arc-shaped portion.

4. The centrifugal fan of claim 3, wherein the motor includes a metal motor holding member exposed to the intermediate arc-shaped portion.

5. The centrifugal fan of claim 4, wherein the motor holding member includes an outer circumferential surface and a heat sink attached to the outer circumferential surface, the heat sink including fins protruding radially outward.

6. The centrifugal fan of claim 5, wherein the heat sink includes circumferentially-extending gaps defined between the fins.

7. The centrifugal fan of claim 1, wherein the intermediate arc-shaped portion is arranged to open toward an outer circumferential surface of the motor, the intermediate arc-shaped portion including an inner peripheral portion and a radial middle portion, the inner peripheral portion including an axial dimension equal to or greater than an axial dimension of the radial middle portion.

8. The centrifugal fan of claim 1, wherein the intermediate arc-shaped portion includes a cross section orthogonal or substantially orthogonal to the circumferential direction, each of the first wind tunnel portion and the second wind tunnel portion including a cross section orthogonal or substantially orthogonal to the circumferential direction, the cross section of the intermediate arc-shaped portion being smaller in area than the cross section of each of the first wind tunnel portion and the second wind tunnel portion.

9. The centrifugal fan of claim 1, wherein the intermediate arc-shaped portion includes an upstream portion arranged to communicate with the first wind tunnel portion and a downstream portion arranged to communicate with the second intake port through a passageway arranged radially outward of the second impeller chamber.

10. The centrifugal fan of claim 1, wherein each of the first impeller chamber, the second impeller chamber, and the intermediate arc-shaped portion is defined between two members arranged one above the other.

11. The centrifugal fan of claim 10, wherein a sealing material is interposed between the two members.

12. The centrifugal fan of claim 1, wherein the housing includes:

a first connecting member including an upper surface defining a lower interface of the first impeller chamber and a lower surface defining an upper interface of the intermediate arc-shaped portion; and a second connecting member including an upper surface defining a lower interface of the intermediate arc-shaped portion and a lower surface defining an upper interface of the second impeller chamber.

13. The centrifugal fan of claim 1, wherein the upstream side impeller and the downstream side impeller have a mirror symmetry shape or a substantial mirror symmetry shape with respect to each other and are arranged in a vertically inverted posture with respect to each other.

14. The centrifugal fan of claim 1, wherein the exhaust port is arranged higher than the downstream side impeller.

15. The centrifugal fan of claim 1, wherein the upstream side impeller includes an upper surface and a first annular protrusion protruding upward from the upper surface;

the downstream side impeller includes a lower surface and a second annular protrusion protruding downward from the lower surface;

the housing includes a first annular groove corresponding to the first annular protrusion and a second annular groove corresponding to the second annular protrusion; and labyrinth portions having a reduced clearance are defined between the first annular protrusion and the first annular groove and between the second annular protrusion and the second annular groove.

16. The centrifugal fan of claim 15, wherein a recess portion is arranged near the first annular protrusion or the second annular protrusion, a balancing member being attached to the recess portion.

17. The centrifugal fan of claim 1, wherein the motor is an inner-rotor-type motor.

* * * * *